United States Patent [19]

Kishi et al.

[11] 4,315,119

[45] Feb. 9, 1982

[54] TANK TYPE GAS CIRCUIT BREAKER

[75] Inventors: Tuneo Kishi; Koji Sasaki; Michio Moriya, all of Hitachi, Japan

[73] Assignee: Hitachi, Ltd., Tokyo, Japan

[21] Appl. No.: 107,086

[22] Filed: Dec. 26, 1979

[30] Foreign Application Priority Data

Jan. 16, 1979 [JP] Japan ..... 54/2204
Jan. 24, 1979 [JP] Japan ..... 54/6056
Feb. 2, 1979 [JP] Japan ..... 54/10417

[51] Int. Cl.[3] ..... H01H 33/14; H01H 33/88

[52] U.S. Cl. ..... 200/145; 200/148 R; 200/148 A

[58] Field of Search ..... 200/145, 148 A, 148 R

[56] References Cited

U.S. PATENT DOCUMENTS 4,009,458 2/1977 Kishi et al. ..... 200/148 A
4,087,664 5/1978 Weston ..... 200/145

FOREIGN PATENT DOCUMENTS 1159539 12/1963 Fed. Rep. of Germany ..... 200/145

*Primary Examiner*—Robert S. Macon
*Attorney, Agent, or Firm*—Craig and Antonelli

[57] ABSTRACT

A tank type gas circuit breaker comprises a sealed vessel which is filled with an insulating gas, insulating support means whose one end is fixed to the sealed vessel, a bracket which is fixed to the other end of the insulating support means, a linkage which is disposed in the bracket, and at least two interrupting units which are operated for opening and closure by means of the linkage and which are connected in electrical series with each other. At least two interrupting units which effect switching operations along axes being substantially parallel are disposed on at least one end face side of the bracket in a manner to be staggered in a direction of the axes, and one of the adjacent interrupting units located on the bracket side has its stationary contact member electrically connected with a movable contact member of the other interrupting unit at all times.

17 Claims, 5 Drawing Figures

TANK TYPE GAS CIRCUIT BREAKER

BACKGROUND OF THE INVENTION

A tank type gas circuit breaker is so constructed that a sealed vessel is formed of a cylindrical tank, which is filled with an insulating gas such as sulfur hexafluoride ($SF_6$) gas, and that an interrupting portion is included therein which is electrically insulate from the tank.

In a tank type gas circuit breaker of high voltage and large capacity, one interrupting set of fundamental structure is typically provided which is composed of two interrupting units connected in series. For still higher voltage classes, a plurality of interrupting sets of such fundamental structure are connected in electrical series.

For this reason, the length of the tank type gas circuit breaker in the direction of the switching operations of the interrupting units increases with the interrupting capacity thereof. By way of example, the length of a tank type gas circuit breaker provided with four series interrupting points needs to be approximately double that of one provided with two series interrupting points. The length becomes yet greater in circuit breakers of higher voltage classes.

U.S. Pat. No. 4,095,068 discloses a gas circuit breaker in which two interrupting units are arranged on different axes within a tank, whereby the interrupting units are juxtaposed in a manner to overlap structurally. With this circuit breaker, although the length in the direction of the switching operations of the interrupting units decreases to some extent, the diameter of the tank increases and the structure becomes complicated. The reason for this is that the current path becomes complicated because the two interrupting units are arranged in positions overlapping in the direction of the switching operations, which is undesirable in that they mutually exert influence of the gas having contributed to arc extinction. Another disadvantage is that the influences of electromagnetic forces increase.

SUMMARY OF THE INVENTION

An object of this invention is to provide a gas circuit breaker having a plurality of interrupting portions whose total length in the direction of the switching operations of the interrupting units is shortened.

The invention for accomplishing the state object is characterized by a tank type gas circuit breaker wherein a sealed vessel filled with an insulating gas includes therein insulating support means whose one end is fixed to the sealed vessel, a bracket which is fixed to the other end of the insulating support means, and at least two interrupting units which are subjected to switching operations by means of a linkage disposed within the bracket, the interrupting units being connected in electrical series; characterized in that at least two interrupting units which effect switching operations along substantially parallel axes are disposed on at least one end face side of said bracket in a manner to be staggered in the axial direction, and that one of the adjacent interrupting units located on the bracket side has its stationary contact member electrically connected with a movable contact member of the other interrupting unit at all times.

DETAILED DESCRIPTION OF THE PREFERRED EMBODIMENTS

An embodiment of this invention will be described with reference to FIGS. 1 to 3.

Figure 1:
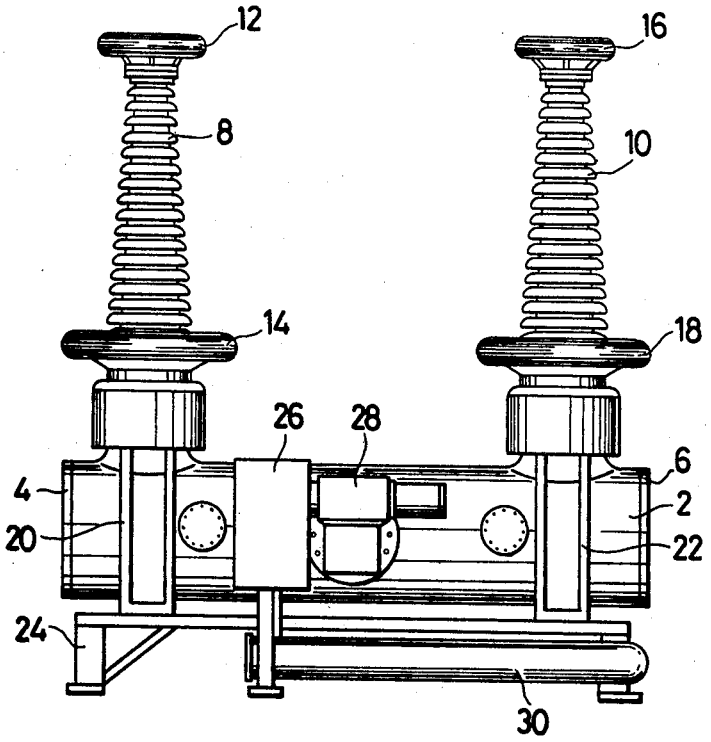
FIG. 1 is a front view of a tank type gas circuit breaker to which this invention is applied.

FIG. 1 is a front view of a tank type gas circuit breaker. In FIG. 1 a tank 2 in which interrupting portions are housed is cylindrical and has both of its ends in the axial direction sealed in a gastight manner by means of end covers 4 and 6. Bushings 8 and 10 are respectively fixed to the axial ends of the tank 2. Shields 12 and 14, and 16 and 18, for moderating electric fields, are respectively mounted on both the axial ends of the bushings 8 and 10. Ribs 20 and 22 for reinforcement are respectively fixed under the bushings 8 and 10, and the tank 2 is fixed to an underframe 24 by way of reinforcing ribs. An operating box 26, in which some parts of a driving device for effecting the switching operations of the interrupting portions are encased, is fixed sidewards of the tank 2. A mechanism unit which couples the driving device and the interrupting portions is mainly encased in a mechanism case 28. The driving device is equipped with an air reservoir 30 because it is designed to carry out the opening operations of the interrupting portions with pneumatic pressure. The tank 2 can be in a spherical form instead of the cylindrical shape. The mechanism case 28 and the operating box 26 can also be arranged under the tank 2.

Figure 2:
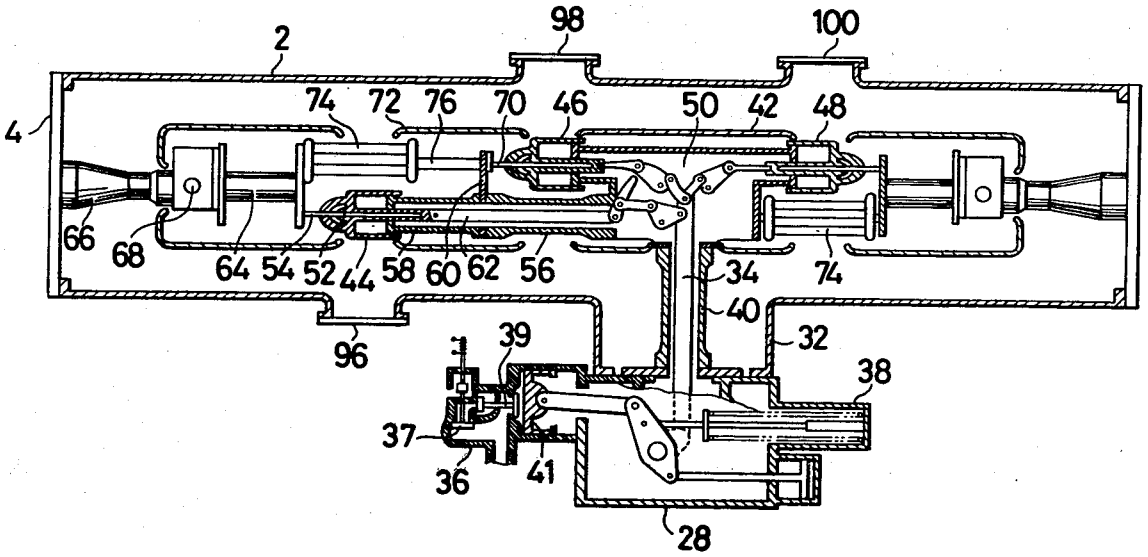
FIG. 2 is a transverse sectional view of a tank type gas circuit breaker with three series interrupting points according to this invention.

FIG. 2 is a transverse sectional view of a tank type gas circuit breaker which is interrupted at three series points, and in which three puffer type interrupting portions connected in series are provided as the interrupting portions within the tank 2.

A cylindrical portion 32 which projects horizontally is formed at the side wall of the tank 2 substantially in the middle in the axial direction of the tank. Arranged within the portion 32 is a first insulating plunger 34 which couples movable parts of the interuppting portions and the driving device. The hollow or interior of the portion 32 is gastightly sealed by the mechanism case 28, and the tank 2 is provided as a sealed vessel in the manner already described. Usually, the sealed vessel 2 is filled with sulfur hexafluoride ($SF_6$) gas.

Upon an interrupting command, an operating device 36 for effecting opening of the breaker is activated to drive a pilot valve 37 and a control valve 39 in succession which results in a main piston 41 being actuated by the application of compressed air thereto. The operating device for opening the breaker, however, is not restricted to this type of device, but can adopt various constructions. By way of example, it can be constructed of a spring-actuated device, a hydraulically-actuated device or an electromagnetically-actuated device. An output from such operating device 36 for opening the breaker is transmitted as an opening operating force to the interrupting portions by way of the insulating plunger 34. On the other hand, an output from an operating device 38 for closure of the breaker, which is exemplified by a spring device, is transmitted as a closure operating force to the interrupting portions by way of the insulating plunger 34. The operating device 38 for closure of the breaker can adopt various constructions similarly to the operating device 36, and the devices 36 and 38 may be similar or different, as apparent from FIG. 2.

Within the portion 32 of the tank 2 there is provided an insulating support means 40 which encloses the insulating plunger 34. Although, in general, the insulating support means 40 is constructed from an insulating cylinder, it can be constructed from a plurality of columnar insulators in another example. Since the portion 32 is formed so as to extend in a substantially-horizontal direction, the insulating support means 40 also extends in a substantially-horizontal direction.

One end of the insulating support means 40 in the axial direction thereof is fixed to the tank 2, while the other end is fixed to a bracket 42 disposed within the tank 2. The bracket 42 carries the interrupting movable parts of the three interrupting units 44, 46 and 48 to be described in detail below. Disposed within the bracket 42 is a linkage 50 which couples the interrupting movable parts of the interrupting units 44, 46 and 48 with the insulating plunger 34. The three interrupting units 44, 46 and 48 disposed on both the end face sides of the bracket 42 in the axial direction thereof are connected in electrical series in the order of the unit 44, the unit 46 and the unit 48. The respective ends of the series combination are connected to central conductors which pass through the bushings 8 and 10. As seen from FIG. 2, the three interrupting units 44, 46 and 48 are arranged along two straight lines parallel to the axis of the tank 2 and are arranged on a substantially-identical plane.

The interrupting unit 44 extending along the first axis has a movable contact member 52 which effects the switching operation along the axis, and a stationary contact member 54 which is disposed in opposition to the movable contact member 52. The construction of the interrupting unit itself and the arc-extinguishing principle of operation thereof are typical of the well-known puffer type gas circuit breaker. The difference of this interrupting unit from the well-known interrupting unit consists in a supporting structure for the interrupting movable part which interlocks with the movable contact member 52.

On one side surface of the bracket 42, one end of an insulating support sylinder 56 serving as second insulating support means is fixed. Fixed at the other end of the insulating support cylinder 56 are conductors 58 and 60, by which the interrupting movable part above described is supported. In the insulating support cylinder 56 there is disposed a second insulating plunger 62, one end of which is coupled to the linkage 50 and the other end of which is coupled to the movable contact member 52 of the interrupting unit 44. The second insulating plunger 62 is located on substantially the same plane as that on which the three interrupting units 44, 46 and 48 are arranged.

Accordingly, the movable contact member 52 of the interrupting unit 44 is coupled with the operating device 36 for opening the breaker and the operating device 38 for effecting closure of the breaker through the second insulating plunger 62, the linkage 50 and the first insulating plunger 34. On the other hand, the stationary contact member 54 of the interrupting unit 44 is fixed to the end cover 4 of the tank 2 through a conductor 64 by means of an insulating support 66. A connecting device 68 is mounted on the conductor 64, and it connects the interrupting unit 44 with the central conductor of the bushing 8.

Regarding the insulating support means for supporting the interrupting movable parts of the three interrupting units 44, 46 and 48, other insulating support means can be added at any desired position in the circumferential direction of the bracket 42. If the added insulating support means has a sufficient mechanical strength, the insulating cylinder 40 indicated as the insulating support means can be used as a protective cylinder which prevents products of decomposition from adhering onto the surface of the first insulating plunger 34. If the insulating plunger 34 has satisfactory insulating characteristics against such decomposition products, the aforecited protective cylinder is not required. Accordingly, the insulating plunger 34 does not always need to be arranged within the insulating cylinder 40.

Such measures against contamination of the plunger by decomposition products becomes important as to the second insulating plunger 62 which is constructed in the shape of, for example, a plate. This is because the second insulating plunger 62 is connected between poles of the interrupting unit 46 and is proximate thereto. If the decomposition products having developed in the interrupting unit 46 accumulate on the second insulating plunger 62, they result in deterioration in the insulating properties of the plunger. In the present embodiment, however, the insulating support cylinder 56 is employed for the support of the interrupting movable part of the interrupting unit 44, and the second insulating plunger 62 is arranged within the insulating support cylinder 56. Accordingly, the second insulating plunger 62 is not subject to the influence of the decomposition products.

The influence of decomposition products on the second insulating plunger 62 can be eliminated by other methods. For example, the interrupting unit 46 may well be enclosed within an insulating cylinder or caused to communicate with the exterior through a filter. Accordingly, the insulating support cylinder 56 can be replaced with a rod-shaped insulating support member. It is also possible to fix the conductors 58 and 60 by the use of insulating support means which is disposed in the diametrical direction of the tank 2 similar to the insulating support means 40.

There will now be described the interrupting unit 46 which is arranged along the second axis of the tank 2. This interrupting unit 46 differs from the well-known interrupting unit insofar as the supporting construction for the stationary contact member 70 is concerned. More specifically, the stationary contact member 70 of the interrupting unit 46 is fixed to a conductor 60 which is fixed to one end of the insulating support cylinder 56. Owing to the conductor 60, the two interrupting units 44 and 46 are connected in electrical series. Accordingly, the conductors 58 and 60 have the function of electrically connecting the movable contact member 52 and the stationary contact member 70 of the adjacent interrupting units 44 and 46, the function of supporting the movable part of one interrupting unit 44, and the function of supporting in a fixed position the stationary contact member 70 of the other interrupting unit 46.

The interrupting unit 48 is constructed similarly to the interrupting unit 46 described above.

In general, in order to moderate the electric fields acting on the tank, shield cylinders are respectively disposed on the movable contact member side and stationary contact member side of each interrupting unit, and they are maintained at potentials equal to those of the corresponding contact members. The embodiment shown in FIG. 2 takes this point into consideration. One end of a shield cylinder 72 lies in the vicinity of the stationary contact member 70 of the interrupting unit 46, while the other end thereof lies in the vicinity of the movable contact member 52 of the interrupting unit 44 in the state in which the contact members are separated. In other words, the shield cylinder 72 for the tank 2 is disposed opposite the conductors 58 and 60 between the interrupting units 44 and 46, and the interrupting units 44 and 46 are staggered in the axial direction so that the movable contact member 52 and the stationary contact member 70 may be located in the vicinities of the respective axial ends of the shield cylinder 72. Accordingly, the shield cylinder 72 serves to moderate the electric fields acting on the tank 2 and simultaneously improves the potential distribution between the poles of the interrupting units.

A voltage dividing device 74 and a closure resistance device 76 are connected in electrical parallel with the interrupting unit 44. The voltage dividing device 74 equalizes voltages to be applied to the respective interrupting units 44, 46 and 48, and it is generally provided in the form of a condenser. On the other hand, the closure resistance device 76 suppresses closure surges which develop upon closing of the interrupting units 44, 46 and 48.

Figure 3:
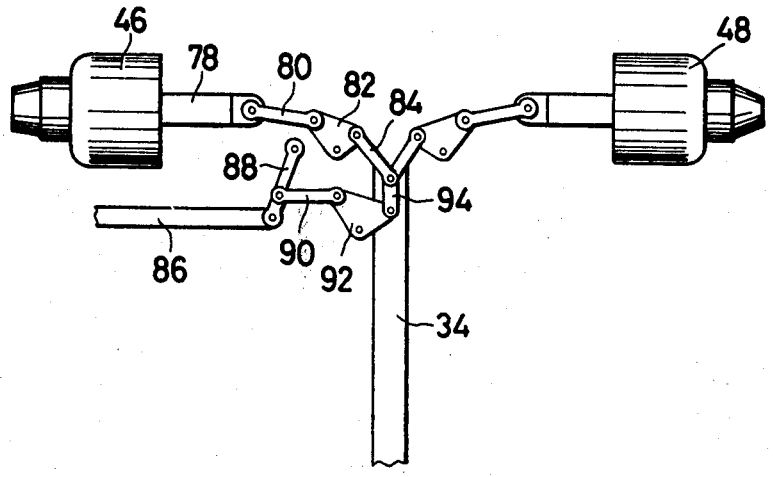
FIG. 3 is an enlarged view of a linkage in FIG. 2.

The details of the linkage 50 are shown in FIG. 3. One end of an interrupting movable part 78 of the interrupting unit 46 is coupled to one end of a rotary lever 82 through a link 80. The other end of the rotary lever 82 is coupled to the insulating plunger 34 through a link 84. On the other hand, the second insulating plunger 62 coupled to the interrupting movable part of the interrupting unit 44 has its one end coupled to the free end of a rotary lever 88 which is rotatably supported at its other end. A position near the free end of the rotary lever 88 is coupled to one end of a rotary lever 92 through a link 90. The other end of the rotary lever 92 is coupled to the insulating plunger 34 through a link 94. Since the linkage is constructed in this manner, the downward drive of the insulating plunger 34 rotates the rotary lever 82 clockwise and the rotary lever 88 counterclockwise. Thus, the respective interrupting units carry out the required opening operations.

Referring back to FIG. 2, openings 96, 98 and 100 for inspecting the interior of the tank 2 are respectively provided in those positions of the side surface of the tank 2 which are disposed in opposition to the interrupting units 44, 46 and 48.

As thus far described, the two interrupting units 44 and 46 are constructed on one end face side of the bracket 42, while the interrupting unit 48 is constructed on the other end face side thereof, so that three series interrupting points are formed as a whole. Thus, the embodiment of FIG. 2 illustrates a tank type gas circuit breaker in which the circuit is interrupted at three series interrupting points. In the case of interruption at four series points, one insulating support means and one bracket may be similarly used. In this case, a fourth interrupting unit is arranged in addition to the three interrupting units in FIG. 2 so that the four interrupting units may become bilaterally symmetric with respect to the bracket 42, and all of the interrupting units are simultaneously operated by the linkage 34. The movable contact member of the fourth interrupting unit and the stationary contact member of the interrupting unit 48 are electrically connected in series. Thus, a tank type gas circuit breaker which is interrupted at four series interrupting points is constructed in a manner which is similar to that seen in the left-hand portion of FIG. 5.

Figure 4:
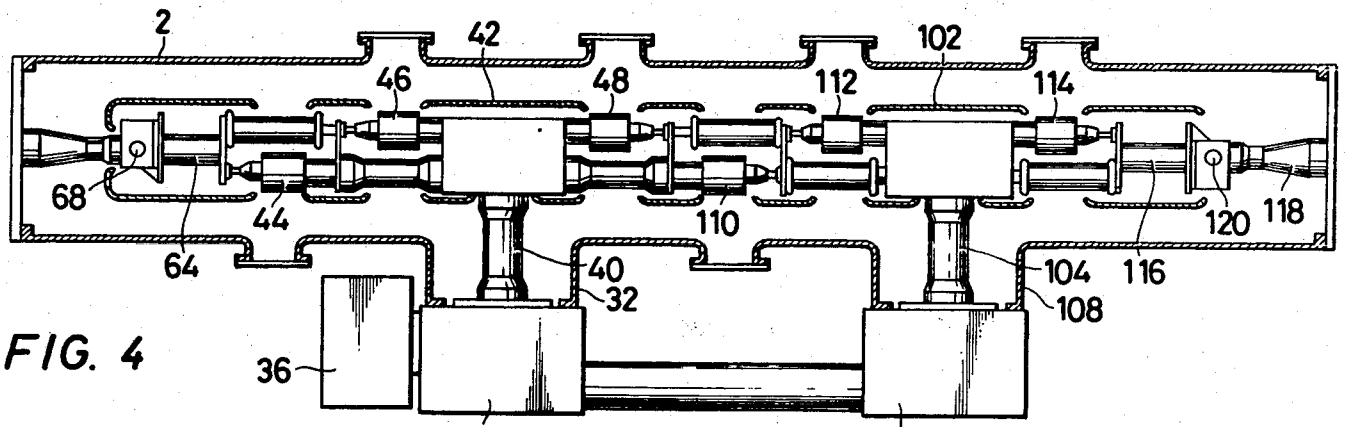
FIG. 4 is a partial sectional view of a tank type gas circuit breaker with six series interrupting points according to this invention, in which many of constituents are not taken in section.
Figure 5:
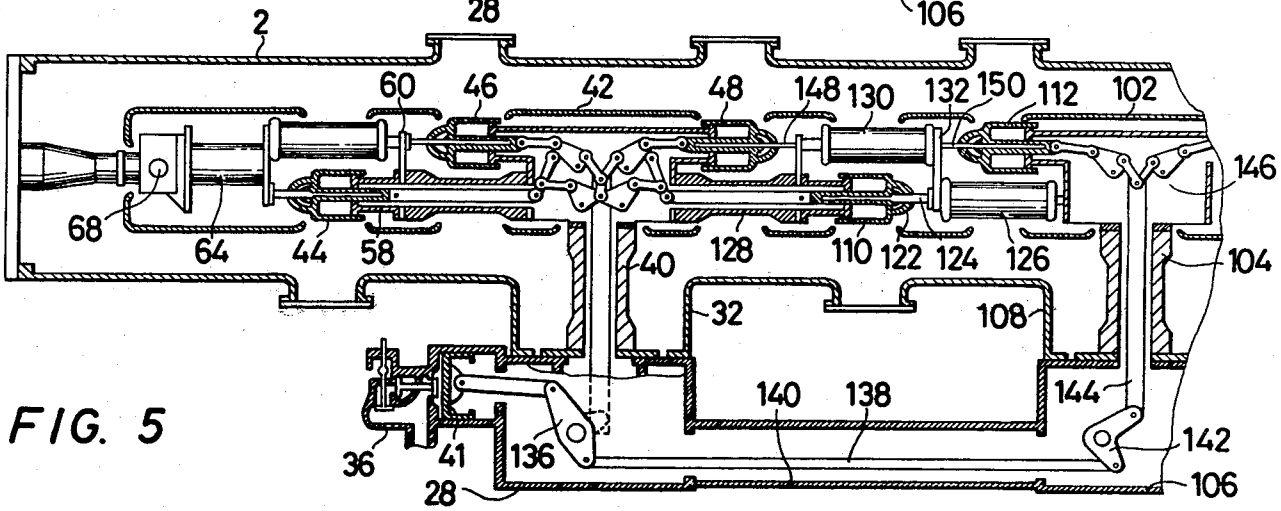
FIG. 5 is a transverse sectional view of the tank type gas circuit breaker in FIG. 4.

FIGS. 4 and 5 show a tank type gas circuit breaker which is interrupted at six series interrupting points. FIG. 4 is a partial sectional plan view in which the interrupting components inside the tank 2 are not taken in section, while FIG. 5 is a plan view in which the interrupting components inside the tank 2 are also taken in section.

In FIGS. 4 and 5, the interrupting units 44, 46 and 48 and the elements disposed in the vicinity thereof have the same structure as in the embodiment illustrated in FIG. 2, and hence, they are assigned the same symbols and are not repeatedly explained. In the present embodiment, a bracket 102, insulating support means 104 and a mechanism case 106 are further provided in addition to the bracket 42, the insulating support means 40 and the mechanism case 28, and a cylinder 108 is formed in the tank 2 anew.

Referring to FIG. 4, two sets of interrupting units 44 and 46, 48 and 110 are respectively constructed at the respective ends of the bracket 42, and all the movable parts of the interrupting portions are carried by the bracket 42. On the other hand, interrupting units 112 and 114 are constructed at the respective ends of the bracket 102, and the interrupting movable parts of the interrupting units are carried by the bracket 102. The structure which consists of the two interrupting units 112 and 114, the bracket 102 and the insulating support means 104 has the same construction as that of a conventional arrangement for two series interrupting points. The stationary contact member of the interrupting unit 114 is fixed to an insulating support 118 through a conductor 116. Connecting devices 68 and 120 serve as terminals which are connected to the central conductors of the bushings. In this manner, the six series interrupting points are constructed between the connecting devices 68 and 120.

The embodiment will now be described in detail with reference to FIG. 5. The four interrupting units 44, 46, 48 and 110 are arranged along two straight lines parallel to the axis of the tank 2, and are arranged on a substantially-identical horizontal plane. The constructions on both sides of the bracket 42 are symmetrical insofar as these four interrupting units is concerned. Similar to the interrupting unit 44, the interrupting unit 110 extending along the first straight line has a movable contact member 122 which effects a switching operation along the straight line, and a stationary contact member 124 which is disposed in opposition to the movable contact member 122. The stationary contact member 124 is supported and fixed at one end thereof by a voltage dividing device 126 whose other end is fixed to the bracket 102, and the contact member 124 is also connected via conductor 132 to one end of a voltage dividing device 130 whose other end is fixed to second insulating support means 128. The stationary contact member 124 is electrically connected through the conductor 132 with the stationary contact member 150 of the interrupting unit 112 on the side of the bracket 102 at all times.

The operating device 36 for opening the breaker is common to the six interrupting points in this embodiment. A connecting rod 138 is coupled to one output end of a rotary lever 136 which in turn is coupled to the piston 41. The connecting rod 138 extends through the interior of a conduit 140 and is coupled to an input end of a rotary lever 142. An output end of the rotary lever 142 is coupled to a linkage 146 through an insulating plunger 144. Thus, the interrupting movable parts of the two interrupting units 112 and 114 are driven for opening or closure by the operation of the linkage 146.

An important feature of the present embodiment formed with the six series interrupting points consists in a supporting structure for the stationary contact members 148 and 150 of the respective interrupting units 48 and 112 between the brackets 42 and 102. That is, the stationary contact members 148 and 150 are supported in the middle between the two voltage dividing devices 126 and 130, the respective ends of which are mechanically fixed between the second insulating support means 128 and the bracket 102. This becomes possible due to the fact that the interrupting units 48 and 110 are arranged along different axes and that one interrupting unit 110 is disposed so as to shift in the direction of becoming more distant from the bracket 42. By staggering the interrupting unit 110 in the axial direction as described above, the free end side of the second insulating support means 129 can be brought nearer to the interrupting unit 112, and in spite of constructing the three interrupting units 48, 110 and 112 between the brackets 42 and 102, the stationary contact members 148 and 150 can be rigidly supported and fixed by utilizing the voltage dividing devices 126 and 130. Such effects are achieved also when the positions of the interrupting unit 112 and the voltage dividing device 126 are reversed.

In this way, the interrupting units 44, 46, 48, 110, 112 and 114 constructed in the two brackets 42 and 102 are connected in series, and the six series interrupting points are formed as a whole. A current path at this time extends through the connecting device 68, conductor 64, interrupting unit 44, conductor 58, conductor 60, interrupting unit 46, bracket 42, interrupting unit 48, interrupting unit 110, conductor 132, interrupting unit 112, bracket 102, interrupting unit 114, conductor 116 and connecting device 120.

In the gas circuit breaker shown in FIG. 5, which is interrupted at the six series points, the four interrupting units are constructed in one bracket, and the two interrupting units are constructed in the other bracket. However, three interrupting units may well be constructed in each of the brackets. In thise case, a gas circuit breaker with six series interrupting points which is bilaterally symmetric can be constructed in such a way that the interrupting unit on the side including only one interrupting portion within one bracket having the three interrupting units is electrically connected with the corresponding interrupting unit within the other bracket. A gas circuit breaker with six series interrupting points which is not symmetric can also be constructed in such a way that, as illustrated in FIG. 5, the side including the two interrupting units in one bracket is electrically connected with the one interrupting unit in the other bracket. Moreover, according to this invention, a gas circuit breaker which has five or seven or more series interrupting points can be constructed.

This invention brings forth the following effects. (1) The two interrupting units supported on one end face side of the bracket are arranged in a manner to be staggered in the direction of the switching operations thereof. This produces various advantages.

The first advantage is that the diameter of the tank can be made small. This is to be understood from the fact that the cylinders having the maximum diameters in the interrupting units do not overlap.

The second advantage is that the mutual influences by the gas which has constributed to the arc extinction can be lessened.

The third advantage is that, using the conductor, the movable part of one interrupting unit can be supported, while the stationary contact member of the other interrupting unit can be fixed. Since both the interrupting units are connected in electrical series by means of the conductor, the influences by electromagnetic forces are almost negligible.

(2) In the prior art, a bracket in which one interrupting unit is disposed on each side thereof has been supported by one insulating support means. For this reason, a tank type gas circuit breaker formed with three or four series interrupting points requires two insulating support means located at an interval in the axial direction of the tank. Accordingly, two cylinders and mechanism cases which are disposed in correspondence with the two insulating support means are needed, and the exterior structure becomes complicated. Moreover, the axial length of the tank is sharply increased by the two insulating support means. In contrast, according to this invention, only one insulating support means is employed in order to support the interrupting movable parts of three of four interrupting units. In the case of the interruption at the three or four series points, accordingly, only one cylinder is formed in the tank in order to take out the insulating support means, and the exterior construction becomes simple. Since the two interrupting units are disposed in structural parallel on one end face side of one bracket, the axial length of the tank type gas circuit breaker of the present invention becomes about 75% as compared with that of the prior art tank type gas circuit breaker formed with three series interrupting points.

In the case of four series interrupting points, the axial length in this invention becomes about 55% as compared with that in the prior art.

The prior art tank type gas circuit breaker formed with six series interrupting points requires three insulating support means at intervals in the axial direction of the tank. Accordingly, three cylinders and mechanism cases which are disposed in correspondence with the three insulating support means are needed, and the circuit breaker is axially long, not to mention the complicated exterior structure thereof. In contrast, according to this invention, only the two insulating support means are used. Accordingly, the tank may be formed with two cylinders, the exterior view is simple, and the axial length of the tank type gas circuit breaker with six series interrupting points in accordance with this invention is about 60% of that in the prior art. (3) According to this invention, the maintenance and inspection of the respective interrupting units are easy. In important main lines, the period of service interruption for the maintenance and inspection of circuit breakers cannot be made long. Therefore, a method of operations is advantageous wherein only the necessary components of the interrupting units are detached through openings for inspection which are formed in the tank in correspondence with the interrupting units. In the tank type gas circuit breaker according to this invention, the interrupting unit located on the driving device side is staggered in the axial direction with respect to the other interrupting unit as stated previously. Therefore, the inspection opening for one interrupting unit can be formed in a manner to avoid the driving device which includes the operating device for opening and the operating device for closure.

What is claimed is:

1. A tank type gas circuit breaker having a sealed vessel which is filled with an insulating gas; an elongated insulating support within the sealed vessel and having one end thereof fixed to the sealed vessel; a hollow elongated bracket which is fixed to the other end of the insulating support; a plurality of interrupting units disposed within said sealed vessel; means for connecting said interrupting units in electrical series with each other; and linkage means disposed within said bracket for operating said interrupting units for opening and closure thereof; two of said interrupting units being disposed along axes which are substantially parallel to one another and both of said two units being located on one end face side of said bracket so as to be staggered in the direction of their axes, the one of said two interrupting units located adjacent the bracket side having its stationary contact member electrically connected with a movable contact member of the other interrupting unit at all times.

2. A tank type gas circuit breaker according to claim 1, wherein a third interrupting unit which effects a switching operation along either one of the substantially-parallel axes is supported on the other end face side opposite to said one end face side of said bracket, and wherein said interrupting units located on the one side of said bracket and the movable contact member of said third interrupting unit are electrically connected at all times, thereby providing three series interrupting points capable of being operated for opening and closure of the respective interrupting portions by means of a common driving device.

3. A tank type gas circuit breaker according to claim 1, wherein two interrupting units are provided on each of the end face sides of said bracket and are oriented to effect opening operations towards the bracket side thereof respectively, one of said two interrupting units on each end face side being arranged in a manner to be staggered in a direction of becoming more distant from said bracket, a movable contact member of the staggered interrupting unit and a stationary contact member of the other interrupting unit and a stationary contact member of the other interrupting unit on the identical end face side of the bracket being electrically connected at all times, and the movable contact members of the other interrupting units located on said respective end face sides of said bracket being electrically connected at all times.

4. A tank type gas circuit breaker having a sealed vessel which is filled with an insulating gas; first and second elongated insulating supports each having one end thereof fixed to the sealed vessel; first and second hollow elongated brackets which are fixed to the other end of the respective first and second insulating supports; a first unit including a plurality of first interrupting units which are connected in electrical series with each other, and first linkage means disposed within said first bracket for operating said first interrupting units for opening and closure thereof; a second unit including a plurality of second interrupting units which are connected in electrical series with each other, and second linkage means disposed within said second bracket for operating said second interrupting units for opening and closure thereof; in each of said first and second units, two interrupting units are disposed with their axes along two straight, substantially-parallel lines on one end face side of the bracket therein, a third interrupting unit is disposed on the other end face side of the bracket, and one of said two interrupting units on said one side of the bracket has its movable contact member electrically connected with a stationary contact member of the other interrupting unit at all times and is staggered in a direction away from the bracket with respect to said other interrupting unit; said first and second units being juxtaposed in said vessel so that the sides of said first and second brackets each including said third interrupting unit are opposed, stationary contact members of the opposed interrupting unit being electrically connected.

5. A tank type gas circuit breaker according to claim 4, wherein said one interrupting unit in one of said first and second units is oriented in the opposite direction to said one interrupting unit in the other of said first and second units.

6. A tank type gas circuit breaker having a sealed vessel which is filled with an insulating gas, first and second elongated insulating supports each having one end thereof fixed to the sealed vessel, first and second hollow elongated brackets which are fixed to the other end of the respective first and second insulating supports; a first pair of interrupting units connected in electrical series with one another and disposed on one side of said first bracket along axes which are substantially parallel to each other, and a second pair of interrupting units connected in electrical series with one another and disposed on one side of said second bracket along axes which are substantially parallel to each other; linkage means disposed in said first and second brackets for operating said first and second pairs of interrupting units; one of said interrupting units of each pair being staggered with respect to the other interrupting unit of the pair in a direction away from said associated bracket, a stationary contact member of one interrupting unit of each pair being electrically connected with a movable contact member of the other interrupting unit of that pair at all times; and a third interrupting unit which effects a switching operation along either one of said substantially-parallel axes disposed on an end face side of one of said first and second brackets facing the other bracket, said interrupting units located on one side of said first bracket and a movable contact member of said third interrupting unit being electrically connected at all times.

7. A tank type gas circuit breaker according to claim 6, wherein two interrupting units which effect switching operations along said substantially-parallel axes are disposed on said end face of said one bracket facing the other bracket, one of these interrupting units being disposed in a manner to be staggered in a direction away from said one bracket, a stationary contact member of the interrupting unit located on the side of said one bracket being electrically connected with a movable contact member of the other interrupting unit at all times, movable contact members of the interrupting units located on both the end face sides of said one bracket being electrically connected at all times, one interrupting unit is disposed on the other end face side of said other bracket, and a movable contact member of this interrupting unit and movable contact members of said interrupting units located on the one end face side of said other bracket being electrically connected at all times.

8. A tank type gas circuit breaker according to claim 1, 2 or 3, wherein the movable contact member of said other of said two interrupting units and said linkage are coupled through an insulating plunger.

9. A tank type gas circuit breaker according to claim 1, 2, 3, 4, 5, 6 or 7, wherein shield cylinder means for moderating an electric field is disposed within said vessel in a manner to enclose a connecting part between said stationary contact member and said movable contact member of a pair of interrupting units, and said stationary contact member being disposed in the vicinity of one end of said shield cylinder, while said movable contact member in a separated state lies in the vicinity of the other end thereof.

10. A tank type gas circuit breaker according to claim 1, 2 or 3, wherein the one of said adjacent interrupting units which is positioned more distant from said bracket has its movable contact member supported by said bracket through second insulating support means, and a stationary contact member of said other interrupting unit is fixed to said second insulating support means.

11. A tank type gas circuit breaker according to claim 10, wherein said insulating support is an insulating support cylinder, and said movable contact member of said interrupting unit disposed more distant from said bracket and said linkage means are coupled by means of an insulating plunger arranged in said insulating support cylinder.

12. A tank type gas circuit breaker according to claim 10, wherein said stationary contact member of said interrupting unit disposed more distant from said bracket is fixed to said second insulating support through a plate-shaped conductor which is arranged in a manner to join the substantially-parallel axes substantially at right angles thereto, and said second insulating support has an axial length between said bracket and said plate-shaped conductor.

13. A tank type gas circuit breaker according to claim 1, 2, 3, 4, 5, 6 or 7, wherein all the substantially-parallel axes of said interrupting circuits are contained in an identical plane.

14. A tank type gas circuit breaker according to claim 1, wherein an insulating plunger which couples said linkage and a driving device for said linkage is disposed, and said insulating plunger is arranged on a plane containing said substantially-parallel axes, so as to operate in a direction substantially at right angles to said axes.

15. A tank type gas circuit breaker according to claim 14, wherein said insulating support is an insulating support cylinder, in which said insulating plunger is arranged.

16. A tank type gas circuit breaker according to claim 1, wherein a driving device for said linkage is disposed on that side part of said sealed vessel which corresponds to said interrupting unit staggered in the direction away from said bracket, and openings for inspecting the interior of said sealed vessel are respectively formed in those side parts of said vessel which correspond to the respective interrupting units.

17. A tank type gas circuit breaker according to claim 1, 2, 3, 4, 5, 6 or 7, wherein said linkage means includes two rotary levers which are respectively driven and turned by means of a common operating device, said two rotatary levers being supported by said bracket with their turning axes made common, and an output end of one of said rotary levers serving to operate said interrupting unit operating along one of said axes, while an output end of the other rotary lever operates through a second insulating plunger, said interrupting unit operating along the other axis.

* * * * *